United States Patent [19]

Halsey et al.

[11] Patent Number: 4,912,681

[45] Date of Patent: Mar. 27, 1990

[54] SYSTEM FOR CREATING A HOMOGENEOUS ADMIXTURE FROM LIQUID AND RELATIVELY DRY FLOWABLE MATERIAL

[75] Inventors: Johnny H. Halsey, Eldorado; James Erwin, Bearden, both of Ark.

[73] Assignee: IDX, Inc., El Dorado, Ark.

[21] Appl. No.: 336,147

[22] Filed: Apr. 11, 1989

[51] Int. Cl.[4] ..... B01F 15/04

[52] U.S. Cl. ..... 366/160; 222/450; 366/165

[58] Field of Search ..... 366/150, 162, 160, 151, 366/152, 153, 154, 161, 165, 16, 17, 19, 21; 222/450

[56] References Cited

U.S. PATENT DOCUMENTS

| | | | |
|---|---|---|---|
| 3,697,052 | 10/1972 | Andris | 366/162 |
| 4,060,183 | 11/1977 | Puurunen | 222/450 |
| 4,221,307 | 9/1980 | Peterson | 222/450 |
| 4,266,697 | 5/1981 | Zissimopoulos | 222/450 |

*Primary Examiner*—Robert W. Jenkins

*Attorney, Agent, or Firm*—Diller, Ramik & Wight

[57] ABSTRACT

A system for creating an admixture from a liquid and a relatively dry flowable material, such as granular detergent, is provided and includes a hopper for the dry flowable material, a pipe, a pair of valves defining a metering section of the pipe, and a mixing tank into which the dry material and water are introduced. The valves are alternately operated in response to sensed liquid level in the mixing tank to deposit a predetermined quantity of the dry material into the tank, and when the latter occurs, the water is injected tangentially into the tank to create a homogeneous admixture.

13 Claims, 1 Drawing Sheet

SYSTEM FOR CREATING A HOMOGENEOUS ADMIXTURE FROM LIQUID AND RELATIVELY DRY FLOWABLE MATERIAL

BACKGROUND OF THE INVENTION

This invention relates generally to a system which can automatically stop, start and/or proportionally regulate the flow of relatively dry, flowable, particulate or pulverulent material, such as detergent, which is to be admixed with a liquid to form a liquid cleaner. When the system of the invention is used in conjunction with electrical and pneumatic controls, the detergent can be automatically mixed with water to a particular consistency, and this consistency can be efficiently reproduced as desired. The system is particularly designed for self-service or automatic car washes.

DESCRIPTION OF RELATED ART

Heretofore it has been conventional in self-service and automatic car washes to measure a certain amount of granular detergent by hand, add the detergent to a certain amount of water, and stir the water until the desired consistency of liquid cleaner/detergent has been obtained. This can the be dumped into an appropriate tank which feeds coin operated wand applicators of self-service car washes or spray nozzles of automatic car washes.

Another method of obtaining an admixture of granular detergent and water is the utilization of a pair of tanks, one within the other. Detergent is placed in the smaller tank within the larger tank and a spray nozzle directs water over the detergent. The smaller tank admixture overflows into the outer tank, and this spraying and filing continues until the outer tank reaches a predetermined level detected by a sensor which then cuts off the spray of water. If the admixture in the large tank was of improper consistency, as determined by a typical conventional ph sensor, a conventional circulating pump transfers the admixed liquid from the outer tank back into the inner tank until the correct consistency/ph value of the admixture is obtained. This system creates serious problems relative to contamination buildup of the sensing probe(s), the detergent forms into a hard crust, and the physical size of the two tanks is relatively large to store the amount of dry detergent and admixed liquid cleaner required for relatively busy day-to-day operated self-service or automatic car washes.

SUMMARY OF THE INVENTION

The present invention utilizes a system of automatically measuring a predetermined volume of dry detergent and mixing this predetermined volume with a predetermined volume of water. More specifically, a cup of dry detergent is measured, the cup of dry detergent is discharged into a tank or container, and ten gallons of water is injected into the tank under water line pressure to thoroughly admix with the detergent and create a homogeneous admixed liquid detergent. The system includes a relatively large hopper containing dry granular detergent, a pipe preferably oriented vertically between the hopper and a underlying tank, and two valves in the pipe spaced a predetermined distance from each other. The spacing between the valves and the cross-sectional area of the pipe establishes a predetermined volume of what could be considered a metering section of the pipe. With the bottom valve closed and the top valve valve opened, the granular detergent will be gravity-fed into the metering section. Upon the actuation of appropriate sensors, the top valve is closed and the bottom valve is opened whereupon the predetermined volume of the granular detergent from the metering section will drop by gravity into the tank or container. A nozzle of the hose is introduced into the tank adjacent its bottom and water underline pressure is injected into the tank preferably tangentially thereto creating swirling currents which create a homogeneous detergent/water admixture. By using a pressure regulator in the water line and an appropriate solenoid valve, at a predetermined pressure and a predetermined opening time of the water valve, a predetermined volume of water will be introduced into the tank. As an example, if one cup of metered dry detergent is dispensed from the metering section into the tank, the pressure of the water and the opening time of the solenoid valve are so selected as to inject ten gallons of water into the tank to admix with the granular detergent. Alternatively, a liquid level sensor can be located in the tank to cut off the solenoid water valve when the level of the water in the tank indicates a ten volume capacity has been achieved. At the same time that this level/volume of the water in the tank has been achieved, the same high level sensor can energize a solenoid of the lower valve to close the same, open the upper valve through its solenoid, and gravity will once again feed granular detergent from the hopper into the metering section of the pipe for subsequent admixture. Obviously, the lower valve is energized by a low level water sensor in the tank which first closes the upper valve and opens the lower valve, as earlier noted. In this manner the repetitive operation of the two valves assures constant accurate metering of the volume of the granular detergent in the metering section and the admixture thereof with the exact volume of water in the mixing tank. The system, obviously, permits this procedure to repeat itself as often as the demand requires.

With the above and other objects in view that hereinafter appear, the nature of the invention will be more clearly understood by reference to the following detailed description, the appended claims and the several views illustrated in the accompanying drawings.

DESCRIPTION OF THE PREFERRED EMBODIMENT

Figures 1, 2, 3:
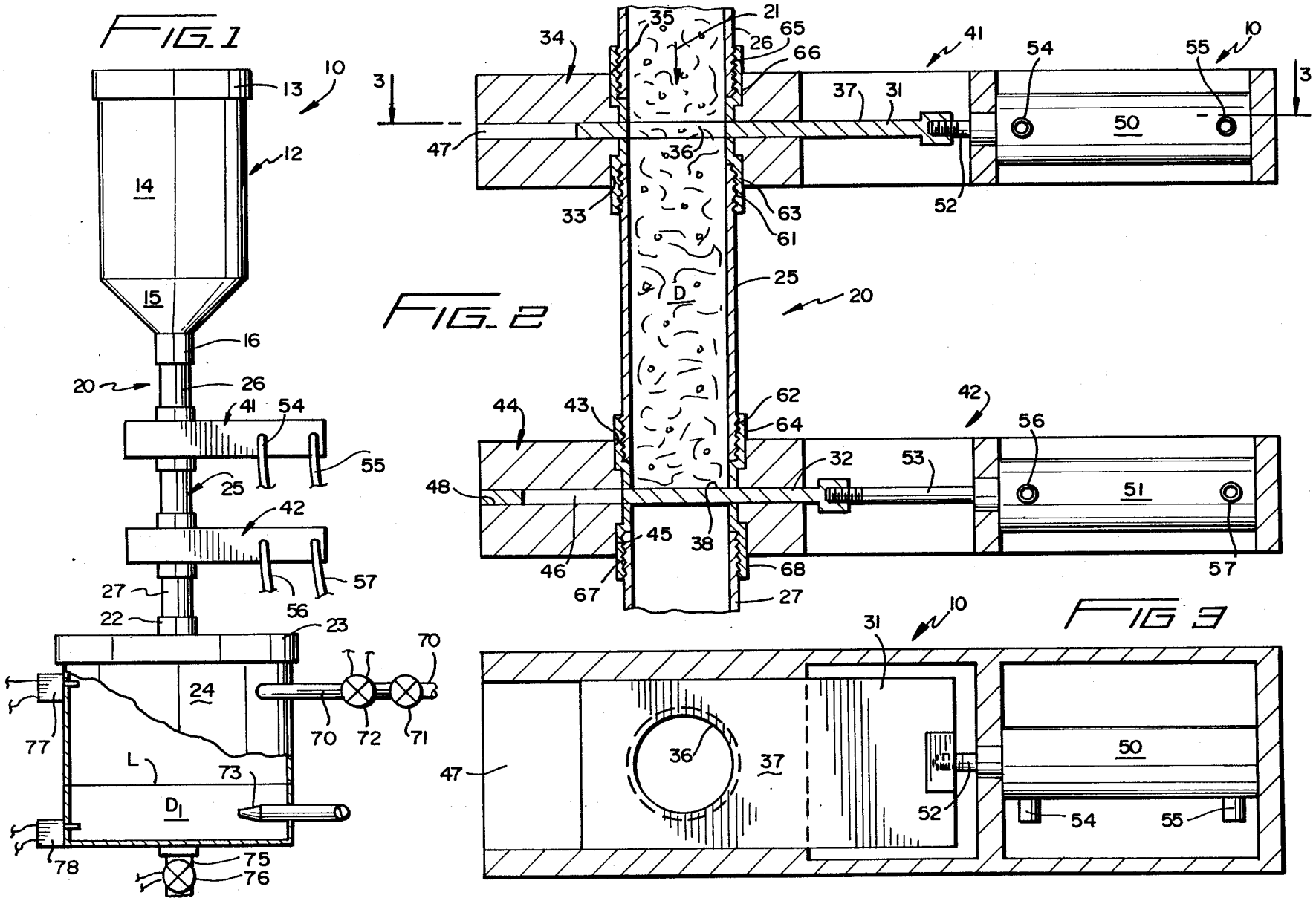
FIG. 1 is a schematic fragmentary side elevational view of a novel soap mixing system of the present invention, and illustrates a hopper for granular detergent, a pipe or tube depending therefrom, two valves setting-off therebetween a meter section of the pipe, and a mixing tank or container having a liquid detergent outlet, a solenoid valve controlled water inlet, and upper and lower liquid level sensors.
FIG. 2 is an enlarged fragmentary vertical sectional view taken through the two valves of FIG. 1, and illustrates each valve in the form of a plate valve having an opening therein, each plate being operable through an associated fluid cylinder, and the valve plates being illustrated with the upper valve plate open and the lower valve plate closed.
FIG. 3 is a cross-sectional view taken generally along line 3—3 of FIG. 2, and illustrates details of the upper valve plate and the concentric relationship between its opening and the axis of the pipe when the upper valve plate is in its open position.

A novel system for creating an admixture from a liquid, such as water, and a relatively dry flowable material, such as granular, powdery or pulverulent detergent, is fully illustrated in FIG. 1 of the drawing and is generally designated by the reference numeral 10.

The admixture creating system 10 includes an upper hopper or tank 12 of a relatively large capacity having a removable cover 13, a container body 14, and a frustoconical portion 15 terminating in a generally cylindrical portion 16. The cover 13 can be removed to introduce dry powder detergent into the hopper 12 which is subsequently discharged through the cylindrical portion 16 under the influence of gravity in a vertical downward direction, as will be more apparent hereinafter.

Means generally designated by the reference numeral 20 in the form of a pipe or tube or sections thereof define a flow path for the dry flowable detergent in a downward direction, as indicated by the arrow 21 in FIG. 2, between an entrance end portion of the tube or pipe 20 generally in the region of the cylindrical portion 16 and an exit end portion 22 (FIG. 1) defined by a cylindrical portion of a cover 23 of a mixing tank, container or admixing chamber 24.

The pipe or tube 20 not only defines the flow path 21, but also defines a metering section generally designated by the reference numeral 25 which is set-off between valve plates 31, 32 of respective valve means 41, 42. In addition to the metering section 25, the tube 20 includes a tube portion 26 above the valve 41 and a tube portion 27 below the valve 42 (FIGS. 1 and 2).

The metering section or portion 25 of the tube 20 has exterior threaded end portions 61, 62 which are threaded into female internally threaded couplings 63, 64, respectively, which are in turn conventionally secured in step bores 33, 43, respectively, of respective valve bodies 34, 44 of the respective valves 41, 42 (FIG. 2). The tube portion 26 has a lower male threaded end portion 65 which is threaded in a female internally threaded coupling 66 conventionally fastened in a stepped bore 35 of the valve body 34. An upper threaded end portion 67 of the tube portion 27 is threaded in a female internally threaded coupling 68 secured in a stepped bore 45 of the valve body 44.

The threaded connection between the couplings 63, 64 through the respective threads 61, 62 of the tube section 25 is such that the tube section 25 can be simultaneously removed from the couplings 63, 64 by rotating the section 25 relative thereto in one direction and simultaneous reassembling or recoupling will occur by rethreading the tube section 25 in the opposite direction. This allows the tube section 25 to be removed and replaced rapidly should it be desired to replace the tube section 25 by other tube sections of longer or shorter lengths to vary the total volume defined by the tube section 25 between the valve plates 31, 32.

The reciprocal valve plates 31, 32 are generally rectangular (FIG. 3) and each includes an opening 36, 46, respectively, which corresponds in diameter to the internal diameter of the tube 20, including each of the sections or portions thereof, and the innermost or smallest interior diameters of the stepped female threaded couplings 63, 64, 66 and 68. Top surface portions 37, 38 of the valve plates 31, 32, respectively, are not apertured, and the size thereof is such as to totally close flow of the granular material downwardly along the flow path 21 when the valve plates 31, 32 are in their leftmost position, as viewed in FIG. 2, which is the illustrated position of the valve plate 32.

The reciprocal valve plates 31, 32 are mounted for sliding reciprocal motion in respective slots 47, 48 of the respective valve bodies 34, 44 and are reciprocated between the relative positions shown in FIG. 2 by conventional fluid cylinders 50, 51, respectively, having pistons (not shown) and piston rods 52, 53, respectively. The piston rods 52, 53 are threaded in a conventional manner to the respective valve plates 31, 32, as is clearly illustrated in FIG. 2. Each of the cylinders 50, 51 includes conventional ports 54, 55 and 56, 57, respectively, into and out of which air or a like fluid medium can be conducted to reciprocate the rods 52, 53 and the associated valve plates or valves 31, 32.

A water pipe 70 (FIG. 1) is connected to a suitable source of water, such as a conventional water main, and includes an adjustable pressure regulator 71 and a servo-operated on-off valve 72. A forward end portion of the pipe 70 ends in an nozzle 73 which is disposed internally of the tank 24 and generally tangential to the cylindrical wall (unnumbered) thereof. When the granular material is dischared from the pipe 20 into the tank 24 and water is introduced into the tank 24 through the nozzle 73, the tangential location of the nozzle 73 swirls and agitates the water resulting in a thorough homogenous admixture, and the resultant admixed liquid is discharged through an outlet, tube or pipe 75 through an appropriate servo-operated on-off valve 76.

Conventional sensors 77, 78 are located at relatively higher and lower points of the tank 24 and function in a conventional manner to detect or sense upper and lower liquid levels of the admixture.

OPERATION

It is assumed that the mixing system 10 is part of an overall automatic car wash, granular detergent D not only fills the hopper 12, but also fills the tube sections 25, 26, as shown in FIG. 2, the valve plates or valves 31, 32 are in the positions shown in FIG. 2, and an earlier quantity of the admixed water and granular detergent forming a liquid detergent or liquid cleaner D1 is at a level L between the liquid level sensors 77, 78.

As cars pass through the automatic car wash, the outlet solenoid-operated valve 76 intermittently operates to direct water from the outlet 75 to the liquid detergent spray nozzles (not shown) of the car wash. Once the level L of the liquid detergent D1 drops below the low liquid level sensor 78, a solenoid is operated to introduce air into the port 55 of the cylinder 50 which shifts the plate 31 to the left (FIG. 2) bringing the portion 37 into position preventing flow of the detergent D downwardly from the hopper 12. Through the use of a limit switch or a sequence valve, once the valve 31 is closed, the pressurized air is introduced into the port 56 which retracts the piston rod 53 bringing the opening 46 into concentric alignment with the tube sections 25, 27. The detergent D in the metering section 25 will now fall under the influence of gravity through the opening 46 and the tube portion 27 into the tank 24. A limit switch or sequence valve (not shown) associated with the bottoming out of the valve plate 32 energizes the solenoid of the valve 72 causing the water under regulated pressure to be ejected tangentially into the tank 24 through the nozzle 73 causing high agitation and swirling and, thus, resulting in homogenous admixture of the detergent D and the water to form the liquid cleaner or detergent D1. The water is continuously injected into the tank 24 through the nozzle 73 until the level L is sensed by the upper liquid level sensor 77 which cuts off the solenoid of the valve 72 and operates a valve to introduce air into the port 57 to move the valve plate 32 back to the position shown in FIG. 2. At this point in the sequence of operation there is no granular detergent D in the metering section 25. However, as soon as the valve plate 32 reaches its closed position, the sequencing valve or another limit switch is operated to move the valve plate 31 to the right bringing the opening 36 into alignment with the sections 25, 26 resulting in the gravity flow downwardly along the flow path 21 of the detergent D from the hopper 12 into and filling up the metering section 25. The system basically remains static from this point until the liquid level L again reaches the sensor 78 at which time the valve 31 is shifted to the left, the valve 32 is shifted to the right, the metered quantity of the detergent D in the metering section 25 is deposited in tank 24, the valve 72 opens, water is introduced tangentially into the tank 24 and agitates/admixes with the liquid forming another batch of liquid detergent D1, the level L rises until sensed by the upper liquid sensor 77, the valve 32 closes (the metering section 25 being momentarily empty) and the valve 31 opens, thus repeating the cycle.

The volume of the detergent D metered by the metering section 25 is preferably one cup and the amount of water injected into the tank 24 per cup is preferably 10/12 gallons. However, all of this can vary depending upon the throughput of the car wash system, the concentration of the granular detergent D, etc. Thus, though the size of the metering section 25 is selected to dispense one cup of the granular/powdery detergent D, the section 25 can be readily removed and replaced by other longer or shorter sections necessitating only the raising or lowering, respectively, of the hopper 12. While the system 10 has been described specifically in conjunction with an automatic car wash, obviously, the same can be utilized in conjunction with a self-service wand-type car wash, or virtually any system in which a predetermined amount of granular/pulverulent material is to be admixed with a liquid. For example, the system 12 could be utilized in a restaurant with instant coffee being housed in the hopper 12 and hot water being injected outwardly of the nozzle 73. By insulating and heating the tank 24, a predetermined quantity of coffee could be produced upon a repetitive basis without ever depleting the supply, as commonly occurs in conventional coffee dispensing systems.

Although a preferred embodiment of the invention has been specifically illustrated and described herein, it is to be understood that minor variations may be made in the apparatus without departing from the spirit and scope of the invention, as defined in the appended claims.

I CLAIM:

1. A system for creating an admixture from a liquid and a relatively dry flowable material comprising means for defining a flow path for relatively dry flowable material between respective entrance and exit end portions thereof, said flow path means including a metering section between said entrance and exit end portions, said metering section being of a predetermined length as established by first and second valve means for respectively controlling the introduction of dry flowable material into said metering section and the dispensing of dry flowable material out of said metering section, means for defining a source of dry flowable material in fluid communication with said entrance end portion whereby dry flowable material will flow along said flow path to said first valve means, means for defining an admixing chamber in fluid communication with said exit end portion whereby dry flowable material will flow along said flow path from said second valve means, means for closing said flow path by said second valve means and opening said flow path by said first valve means whereby said metering section is filled with a predetermined volume of the dry flowable material, means for closing said flow path by said first valve means and opening said flow path by said second valve means whereby the predetermined volume of the dry flowable material is dispensed from said metering section into said admixing chamber, means for introducing liquid into said admixing chamber thereby creating a liquid/dry flowable material admixture, means for effecting homogeniety of the liquid and dry flowable material admixture, and said homogeniety effecting means includes means for directing said liquid generally tangentially into said admixing chamber.

2. The admixture creating system as defined in claim 1 wherein said liquid directing means directs liquid into said admixing chamber adjacent a bottom thereof.

3. The admixture creating system as defined in claim 2 including low level sensing means associated with said admixing chamber in response to the operation of which said flow path is closed by said first valve means and opened by said second valve means.

4. The admixture creating system as defined in claim 2 including low level sensing means associated with said admixing chamber in response to the operation of which said flow path is closed by said first valve means and opened by said second valve means, and said liquid-introducing means being operative to introduce liquid into said admixing chamber in response to the operation of said low level sensing means.

5. The admixture creating system as defined in claim 2 including low level sensing means associated with said admixing chamber in response to the operation of which said flow path is closed by said first valve means and opened by said second valve means, said liquid-introducing means being operative to introduce liquid into said admixing chamber in response to the operation of said low level sensing means, and high level sensing means associated with said admixing chamber in response to the operation of which said liquid-introducing means is disabled.

6. The admixture creating system as defined in claim 5 wherein said flow path defining means established a generally vertical flow path whereby the dry flowable material will flow therethrough under the influence of gravity.

7. The admixture creating system as defined in claim 1 including means for controlling the amount of liquid introduced into said admixing chamber to thereby achieve a desired ratio of liquid and dry flowable material of the admixture.

8. The admixture creating system as defined in claim 1 wherein said flow path defining means establishes a generally vertical flow path whereby the dry flowable material will flow therethrough under the influence of gravity.

9. The admixture creating system as defined in claim 1 wherein said first and second valve means include respective first and second valves disposed in spaced generally parallel relationship to each other.

10. The admixture creating system as defined in claim 1 wherein said first and second valve means include respective first and second slide valves disposed in spaced generally parallel relationship to each other.

11. The admixture creating system as defined in claim1 including low level sensing means associated with said admixing chamber in response to the operation of which said flow path is closed by said first valve means and opened by said second valve means.

12. The admixture creating system as defined in claim 1 including low level sensing means associated with said admixing chamber in response to the operation of which said flow path is closed by said first valve means and opened by said second valve means, and said liquid-introducing means being operative to introduce liquid into said admixing chamber in response to the operation of said low level sensing means.

13. The admixture creating system as defined in claim 1 including low level sensing means associated with said admixing chamber in response to the operation of which said flow path is closed by said first valve means and opened by said second valve means, said liquid-introducing means being operative to introduce liquid into said admixing chamber in response to the operation of said low level sensing means, and high level sensing means associated with said admixing chamber in response to the operation of which said liquid-introducing means is disabled.

* * * * *